US008485250B1

(12) United States Patent
Rose

(10) Patent No.: US 8,485,250 B1
(45) **Date of Patent: *Jul. 16, 2013**

(54) SEALED WELL CELLAR

(76) Inventor: James A Rose, Anchorage, AK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/136,347

(22) Filed: Jul. 28, 2011

Related U.S. Application Data

(60) Division of application No. 12/214,166, filed on Jun. 17, 2008, now Pat. No. 7,987,904, which is a continuation-in-part of application No. 11/799,832, filed on May 2, 2007, now Pat. No. 8,127,837, which is a continuation-in-part of application No. 11/338,912, filed on Jan. 23, 2006, now Pat. No. 7,637,692.

(51) Int. Cl.
*E21B 19/00* (2006.01)

(52) U.S. Cl.
USPC ..... 166/81.1; 166/75.11; 405/52

(58) Field of Classification Search
USPC ..... 166/85.2, 81.1, 96.1, 75.11, 341; 405/6, 405/52
See application file for complete search history.

(56) References Cited

U.S. PATENT DOCUMENTS

| | | | | |
|---|---|---|---|---|
| 4,416,328 | A * | 11/1983 | Baski | 166/65.1 |
| 4,842,443 | A * | 6/1989 | Argandona | 405/52 |
| 5,886,314 | A * | 3/1999 | Sims | 219/121.44 |
| 7,637,692 | B1 * | 12/2009 | Rose | 405/52 |
| 2003/0051882 | A1 * | 3/2003 | Hitchon | 166/378 |

FOREIGN PATENT DOCUMENTS

GB 002216623 * 10/1989

* cited by examiner

*Primary Examiner* — Sean Andrish
(74) *Attorney, Agent, or Firm* — Richard K Thomson

(57) ABSTRACT

A well cellar system includes a substantially planar base plate, the base defining an aperture sized to receive a conductor pipe. The planar base plate is an integral structural member which, in conjunction with the seal between the base plate and the wall and the riser and the conductor, are sufficiently robust to support the weight of the conductor pipe and its auxiliary equipment. The sealed well cellar is afforded with a laterally extending flange which serves as an anti-buoyancy anchor. A anti-buoyancy port allows the upward floatation pressure to be balanced out by water pressure within the cellar during placement to avoid floatation. A sacrificial anode housing is provided with a removable lid and holes for allowing passage of electrolyte. Although the preferred embodiments of sealed well cellars are metal and plastic, a cementaceous embodiment is also envisioned.

5 Claims, 10 Drawing Sheets

SEALED WELL CELLAR

BACKGROUND

This invention relates to well sites, and more particularly to well cellars. This application is a divisional of U.S. patent application Ser. No. 12/214,166 now U.S. Pat. No. 7,987,904 which is a continuation-in-part of application Ser. No. 11/799,832 filed May 2, 2007 which is a continuation-in-part of application Ser. No. 11/338,912 filed Jan. 23, 2006 now U.S. Pat. No. 7,637,692. In the field of oil and gas exploration/production, a well cellar can be positioned below ground level underneath a drilling rig. Such well cellars may contain equipment such as blow out preventers, valves, and other equipment associated with drilling, completion and other well operations. The walls of the well cellar provide structural support to prevent collapse of the surrounding earth onto the equipment. The well conductor pipe extends through the well cellar into the underlying subterranean formation. During drilling, completion and other well operations, fluids from the drilling rig and production equipment, such as lubricants, drilling mud, completion fluids, and oil, can leak or spill into and out of the well cellar. These spills can create ecological problems, polluting soil samples as well as surface and subsurface aqueous sources. Such corrupted soil areas must be remediated before a well is capped, adding expense to taking an under-producing well off-line.

SUMMARY

The well cellar system of the present invention includes a substantially planar base. The base defines an aperture sized to receive a conductor pipe. At least one side member is attached to the base. The at least one side member and the base defines a cavity. Seal means between the at least one side member and the base substantially prevents flow of fluids between the at least one side member and the base. An attachment between the base and the conductor pipe substantially prevents flow of fluid between the conductor pipe and the base. This sealed well cellar eliminates soil and water pollution which is common with existing systems.

A first aspect of the present invention includes a sealed well cellar comprising a) an integral structural base plate, the base plate having an opening therein for receiving a conductor being load-bearing; b) a vertically extending side wall formed integrally with the base plate to ensure sealing between the vertically extending side wall and the base plate; c) a riser positioned in the opening in the base plate; d) first sealing means between the base plate and the riser preventing fluid flow between the base plate and the riser, e) second sealing means between the riser and the conductor preventing fluid flow between the riser and the conductor; whereby the first and second seal means have sufficient structural integrity to transfer a weight of the conductor and associated drilling equipment to the integral structural base plate. In one preferred embodiment, the second seal means comprises a weld between the riser and the conductor. Preferably, the weld is configured such that 100% of the weld does not lie in any single horizontal cross section. One way to accomplish that is to make the upper edge of the riser beveled. Another is to make it scalloped. It is envisioned that the one of the riser and the conductor may be crimped to swage one toward the other.

The well cellar can be formed with a laterally extending flange portion of the integral structural base plate serving as an anchor to the well cellar to counteract buoyancy effects due to ground water and prevent the well cellar from experiencing upward floatation forces. Alternatively, or in addition, the sidewall of the well cellar may be provided with an anti-buoyancy port formed in a bottom portion, a removable plug having means to secure the removable plug in the anti-buoyancy port. A guard shield may be positioned inside the vertical wall over the anti-buoyancy port preventing egress of fluid-borne solids. Another feature of the well cellar of the present invention is the provision of a housing positioned on a portion of the vertical wall for attaching a replaceable sacrificial anode, the housing having a removable lid and means to secure the replaceable sacrificial anode. An annular support for a work platform may be positioned within the well cellar attached to the vertical wall below grade at a point just above a position which would create an OSHA-defined confined space entry (OSHA stands for Occupational Safety and Health Administration). This avoids compliance with a number of safety factors required for such a confined space.

Conventional well cellars of have at least one additional hole, known as a mouse hole or rat hole to accommodate various auxiliary equipment. Given that the well cellar is now sealed, special provision must be made to accommodate the auxiliary equipment without compromising the seal. In the present embodiment, at least one additional hole is provided in one of the base plate and the side wall for accommodating the auxiliary equipment, and sealing means for the at least one additional hole is provided for preventing fluid flow between the base and the auxiliary equipment. This seal may include a riser section, a gasket and compression means to sealingly engage the gasket between the riser section and the piece of auxiliary equipment. The sealing means may additionally include a threaded portion on an external portion of the riser section and an internally threaded nut which engages the threaded portion and compresses the gasket.

Another feature of the invention comprises a well cellar with a load-bearing and sealing concrete floor comprising a) first outer and second inner annular cement retainers extending about a peripheral portion of the well cellar forming a receiver; b) at least one gasket lying in a bottom portion of the receiver formed by the first and second annular cement retainers; c) a conductor-receiving riser with a laterally extending baffle plate attached thereto; d) a pre-fabricated reinforcement grid extending between the inner cement retainer and the riser, the pre-fabricated grid being made of rebar; e) a culvert pipe having a lower edge portion received in the receiver; f) poured concrete cementing the cylindrical culvert pipe in the receiver and forming a floor for a sealed well cellar. The concrete well cellar further includes retainer lips formed on each of an upper edge of the first outer and the second inner annular cement retainers to prevent the cement annulus from climbing out of the retainer rings.

A final aspect of the invention comprises a method of installing a sealed cement well cellar around a conductor pipe, including the steps of a) excavating a hole to receive the well cellar including i) grading a bottom surface of the hole; covering the bottom surface with sand and/or gravel; iii) compacting the sand and/or gravel added; b) installing a cement template with 1) a conductor-receiving riser over a conductor pipe, 2) a peripheral pipe receiver, c) sealingly attaching the riser to the conductor pipe; d) lowering a cylindrical culvert pipe into the peripheral pipe receiver; e) tamping in at least one gasket adjacent a lower edge of the culvert pipe; f) pouring concrete into the peripheral pipe receiver and between the pipe receiver and the conductor-receiving riser. The details of on eor more embodiments of the invention are set forth in the accompanying drawings and the description below. Other features, objects, and advantages of the invention will be apparent from the description and drawings, and from the claims.

BRIEF DESCRIPTION OF DRAWINGS

The preferred embodiments are described in conjunction with the following drawings in which like reference numerals in the various figures indicate like elements. The various features including the extension ring 70*a*, rain cap 76 *b*, anti-buoyancy port 114*f*, have been depicted with varying configurations of the well cellar 10 but may be used interchangeably on any embodiment.

DETAILED DESCRIPTION

Figure 1:
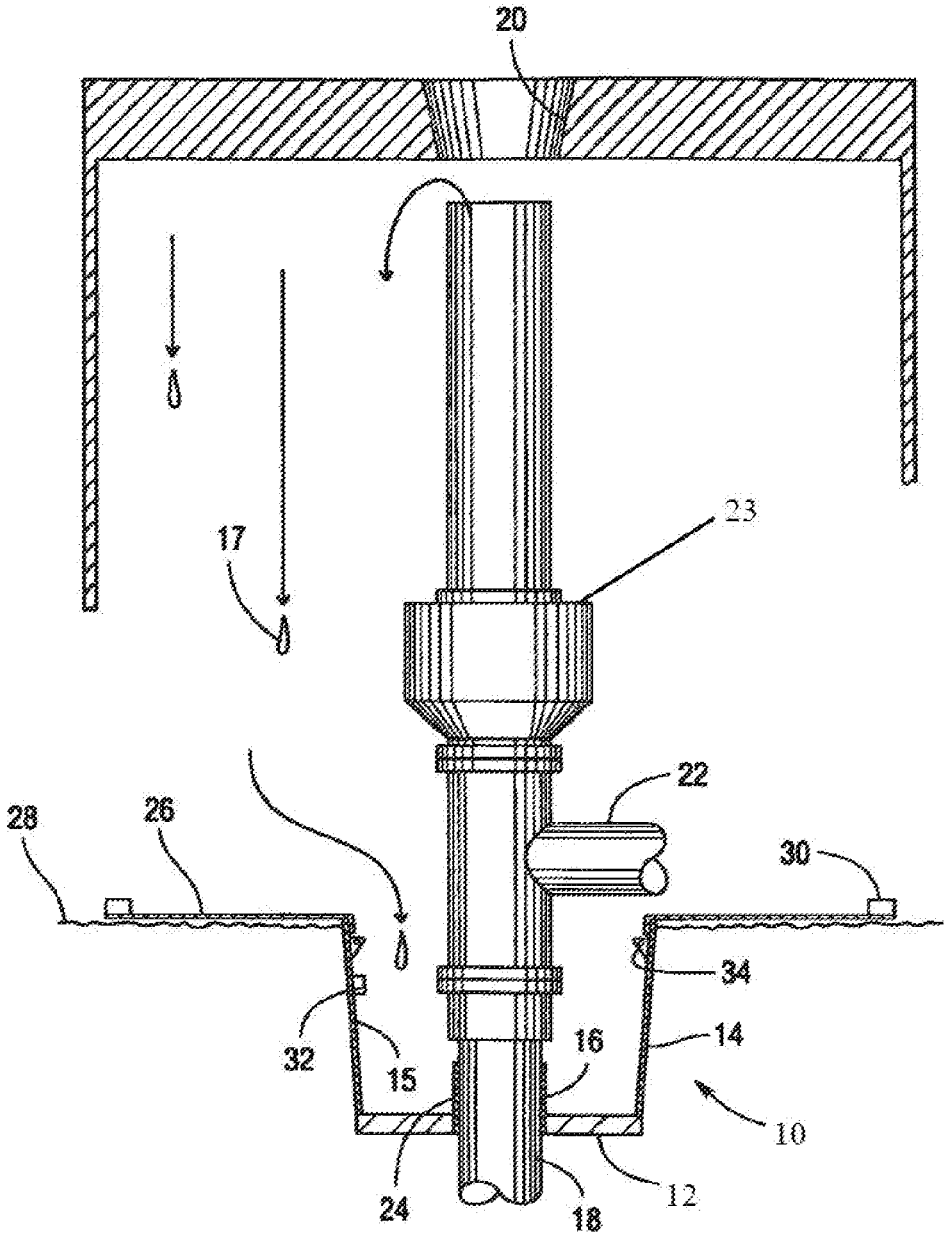
FIG. 1 is a schematic side view of a well cellar system in use.

Referring to FIG. 1, a well cellar system 10 includes a substantially planar base 12 attached to side members or walls 14. Well cellar system 10 can be disposed in an excavation where soil is removed from the ground around the well site. Walls 14 are substantially inflexible to provide structural support to prevent collapse of the surrounding earth into cavity 15 defined by base 12 and walls 14. An aperture 16 which extends through base 12 receives conductor pipe 18. In this instance, conductor pipe 18 is attached to piping 22 which can be, for example, diverter piping. In some instances, valves, blow out preventers such as shown in FIG. 1 at 23, and other equipment associated with drilling and/or completion operations are disposed in cavity 15. Some embodiments include a riser 24 attached to base 12 around aperture 16 that extends substantially concentrically around conductor pipe 18. The riser 24 is preferably attached to and seals to the conductor pipe 18. The riser 24 or conductor pipe 18 may be crimped to facilitate the sealing engagement between the two. In this and other embodiments the base plate is a structural base plate capable of supporting the weight of the conductor pipe 18 and the associated auxiliary equipment (22, 23) used in drilling and completion operations.

As used herein, the term conductor pipe is used to indicate a conductor pipe, riser pipe, surface casing, or other tubular member installed at or about the ground surface. As is discussed in more detail below, the seal between base plate 12 and walls 14 prevents or substantially prevents the flow of fluids between the at least one side member 14 and the base plate 12. Likewise, the seal between the base plate 12 and the conductor 18 prevents or substantially prevents the flow of fluids between the conductor pipe 18 and base plate 12. Fluids 17 from drilling rig 20, such as lubricants, drilling mud, stimulation fluids, and oil, can leak or spill into cavity 15. Sealing or substantially sealing the flow of such fluids out of cavity 15 can limit leakage into and contamination of the earth adjacent cavity 15. Avoiding this contamination eliminates costly cleanup of soil and water surrounding the site. In addition to the base plate 12 being a structural member, it is important that the first seal between base plate 12 and walls 14 and second seal between the riser 24 and conductor pipe 18 be sufficiently robust to hold up under the loading when the weight of conductor pipe 18 and its associated auxiliary equipment is supported by sealed well cellar 10.

In some instances, a fluid impermeable liner 26 is attached to walls 14 and extends radially outward and laterally across the ground surface 28. Liner 26 may be clamped (see hoop-shaped clamp 27, FIG. 2) to the perimeter of walls 14. In some instances, a sealing compound, glue or gasket can be used to ensure a seal between liner 26 and walls 14. A berm 30 can be placed around the outer edges of impermeable liner 26 to contain fluids leaking onto the impermeable liner. Impermeable liner 26 can be manufactured of polymer sheet materials. In some instances, ground surface 28 and impermeable liner 26 are sloped towards cavity 15. This tends to direct fluids leaking onto impermeable liner 26 to cavity 15 which can act as a sump for the collection of the fluids. Berm 30 can be an integral part of impermeable liner 26. In some instances, berm 30 is sealed to liner 26 to prevent leakage between the berm 30 and the liner 26.

For some applications, a fluid level sensor can be installed to monitor the level of fluids in cavity 15. In this instance, a high level alarm sensor switch 32 is mounted on wall 14 and triggered when contacted by fluids in cavity 15. A float sensor could alternatively be used. Other fluid level sensors include, for example, a pressure based sensor that monitors the level of fluids in cavity 15 on an ongoing basis (as opposed to high level alarm sensor switch 32 which is only activated when the fluids in the cavity reach a pre-set level). Data from such sensors can be used as input for controllers operating appropriate pumps (not shown) that can be installed to remove fluids from cavity 15. Such pumps can be permanently installed or temporarily installed as needed.

Padeyes 34 are mounted on walls 14. Padeyes 34 can be used in removal of well cellar system 10 or components thereof from the surrounding earth after the well cellar system is no longer desired, for example by attaching an appropriate piece of heavy machinery such as, for example, a backhoe to padeyes 34 and simply pulling walls 14 (or the entire well cellar system 10) out of the earth. Padeyes 34 may also be used during installation of cellar 10 for assisting in placing the cellar 10 into the cavity in the earth, holding upright during back-filling, etc.

Figure 2:
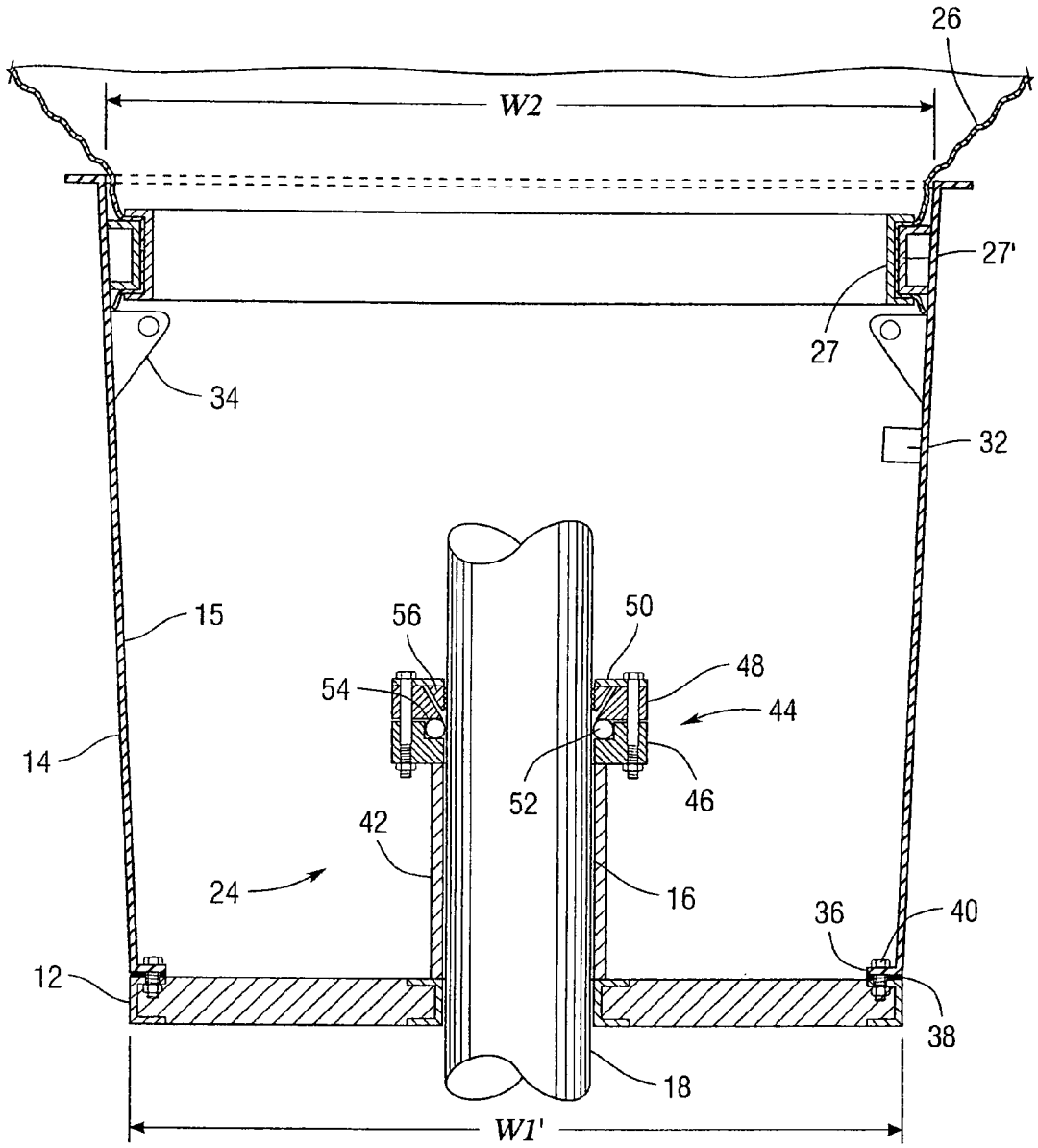
FIG. 2 is a detail cross-sectional view of a first embodiment of well cellar system.

Referring to FIG. 2, cavity 15 has a width $W_1$. As used herein, width $W_1$ is the diameter of the pipe when the walls 14 are formed by a pipe. In some instances, a width $W_1$ measured at base 12 is smaller than a width $W_2$ measured at the open end of cavity, so that the walls 14 slope inward toward the base 12.

The inwardly sloping walls 14 aid in removing the well cellar system 10 from the earth, because when the well cellar system 10 is lifted vertically up from the excavation, the walls 14 come out of contact with the surrounding earth. In this embodiment, walls 14 are formed with a width (diameter) $W_2$ of about 60 inches (152.4 cm) at the open end of the cavity and a width (diameter) $W_1$ of about 58 inches (147.3 cm) at the base 12. Other dimensions of $W_1$ and $W_2$, as well as $W_1$ and $W_2$ being equal, are within the scope of the invention. For example, in areas subject to permafrost and thawing, it may be desirable for $W_1$ and $W_2$ to be equal to prevent post jacking of the well cellar system 10.

As noted above, FIG. 2 depicts walls 14 formed by a section of pipe attached to base 12, the walls and base defining a cylindrical or substantially cylindrical cavity 15. Appropriate pipe includes, for example, corrugated culvert pipe. In other embodiments, walls 14 can be rectangular sheets attached to base 12, the walls and base defining a cavity with a square, rectangular, or other polygonal footprint. Similarly, base 12 and walls 14 can be formed of materials including, for example, steel, aluminum, polymer, polymer reinforced composite, and other materials that provide the necessary structural support and impermeability. It is contemplated that the best mode could take the form of a molded plastic barrel with an opening 16 with means to seal base 12 to the conductor pipe 18.

In some embodiments, walls 14 include a flange 36 extending radially inward from an edge of walls 14 adjacent base 12. A gasket 38 is disposed between base 12 and flange 36 with both the flange and the gasket extending substantially around the outer perimeter of the base. The gasket 38 seals or substantially seals walls 14 to base 12. In other embodiments, flange 36 and gasket 38 are replaced by an alternate sealing mechanism such as, for example, a perimeter weld or a bead of polymer sealant. In some embodiments, walls 14 are bolted to base 12 using bolts 40 that extend through flange 36 into the base 12. Bolts 40 may optionally be configured to fail (i.e., be frangible) thus allowing the detachment of walls 14 from base 12 to leave base 12 in place when wall 14 and other components of the well cellar system 10 are removed from the excavation. Higher strength bolts 40 may be included together with the frangible bolts 40 to support base 12 during installation. After installation, the higher strength bolts 40 or their respective nuts may be removed, so that walls 14 and base 12 are attached only by the frangible bolts 40.

In some embodiments, riser 24 is sealingly attached by welding, gluing or other mechanical attachment to affix it to conductor pipe 18. Riser 24 can attach to the conductor pipe 18 in other manners. For example, riser 24 can include riser walls 42 extending around the aperture substantially perpendicular to base 12 and a riser collar 44. Riser collar 44 includes a gasket ring 46, a slip segment ring 48, and a cover ring 50 which are annular in shape and sized to receive conductor pipe 18. Gasket ring 46, slip segment ring 48, and cover ring 50 are bolted, clamped or otherwise, held together.

Figure 4A:
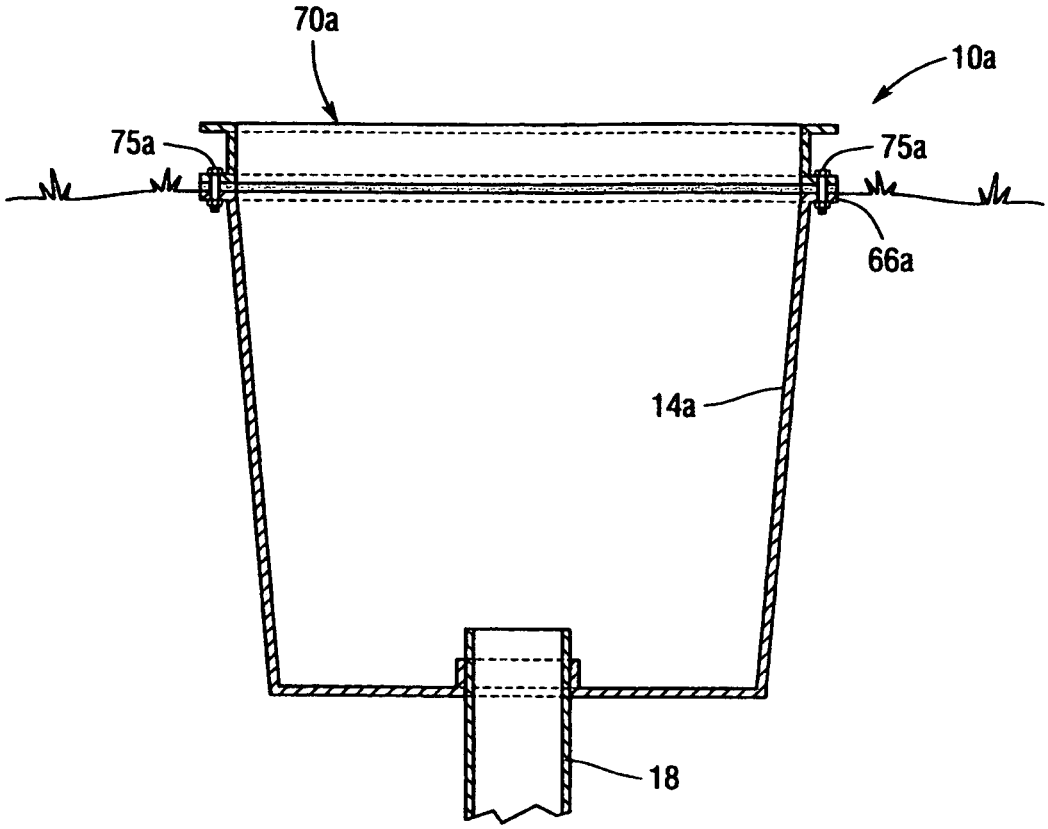
FIG. 4A is a schematic side view of a well cellar featuring an extension ring.
Figure 4B:
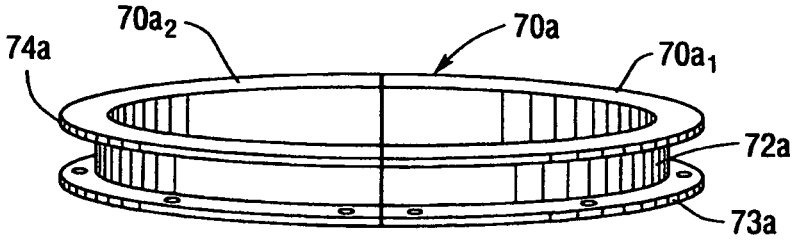
FIG. 4B is a perspective side view of the extension ring shown in FIG. 4A.

A sealed well cellar of the present invention featuring an extension ring is depicted generally in FIG. 4A at 10*a*. One of the problems with existing well cellars is a natural outgrowth of the ability to perform their function well. Well cellars are designed to collect any fluids which are deposited around the conductor pipe 18. This would include runoff from rain and snow. Once this water is added to the well fluids contained in the well cellar, it becomes a hazardous waste which has to be pumped out of the cellar and disposed of in a prescribed manner. It would, therefore, be advantageous to minimize the amount of runoff which finds its way into the well cellar. An annular extension ring 70*a* is provided which can be attached to flange 66*a* of wall 14*a*. As shown in FIGS. 4A and 4B, vertical wall 72*a* has flanges 73*a*, 74*a* extending outwardly therefrom, flange 73*a* being attached by means of bolts 75*a* to flange 66*a*. A gasket can be included to ensure sealing to prevent leakage between flange 66*a* and 73*a*. Extension ring 70*a* will typically be formed in two halves $\mathbf{70}a_1$ and $\mathbf{70}a_2$ to facilitate installation. Halves $\mathbf{70}a_1$ and $\mathbf{70}a_2$ will be seam welded to ensure that there is no leakage. The configuration of extension ring 70*a* depicted here is by way of example only and the flanges need not be included. Extension ring 70*a* prevents runoff from around well cellar 10*a* from entering into the container formed thereby and becoming hazardous waste.

Figure 5:
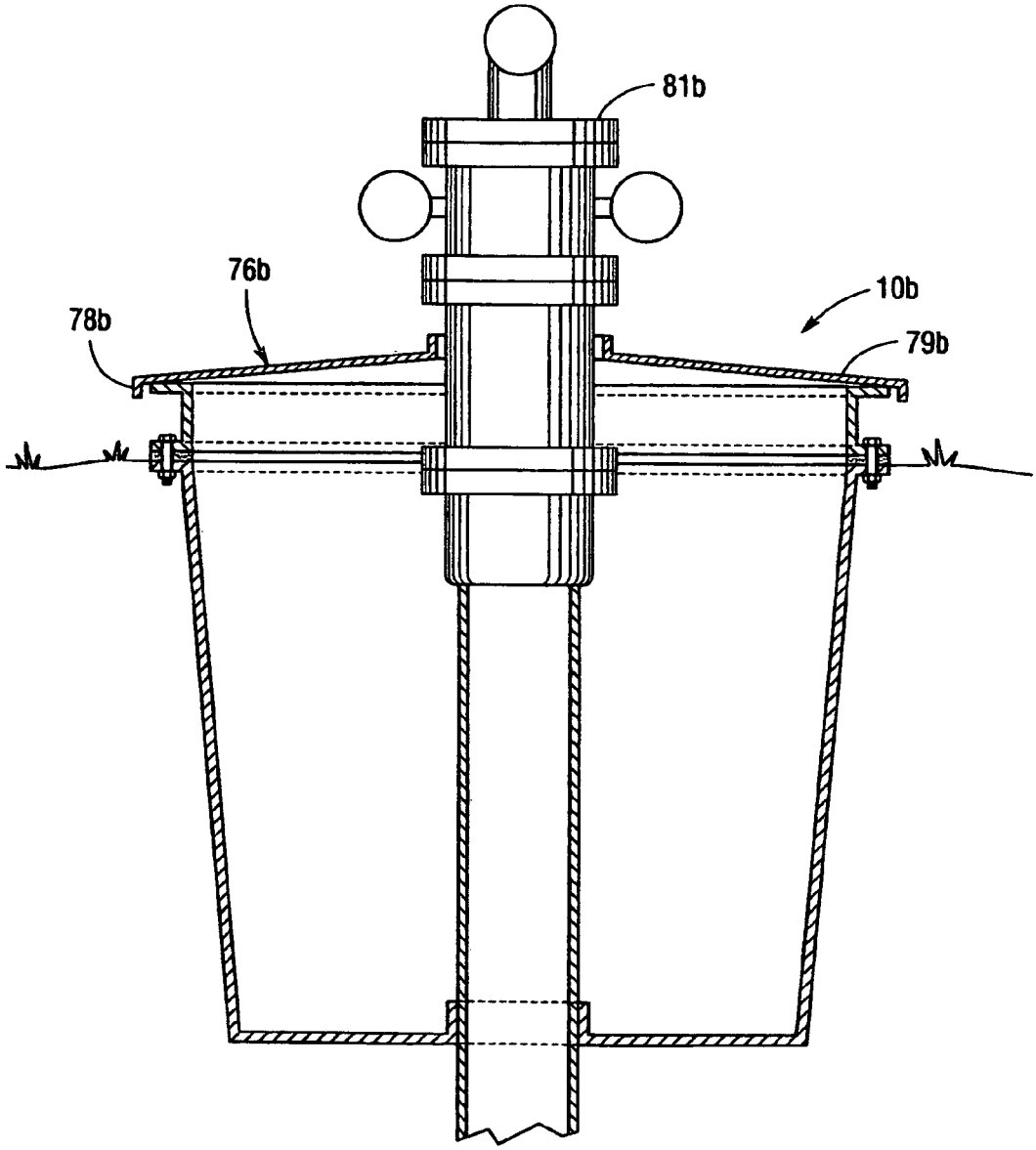
FIG. 5 is a schematic side view of a well cellar featuring a rain hood.

A sealed well cellar of the present invention featuring a rain cap is depicted in FIG. 5 generally at 10*b*. In order to further reduce entry of rain, snow, etc., into the well cellar 10*b*, a rain cap 76*b* is provided. Rain cap 76*b* has a downwardly extending flange 78*b* which overlaps extension ring 70*b*. The primary surface 79*b* slopes downwardly away from conductor pipe 18*b* to permit rain water to runoff and minimize the liquid which finds its way into the well cellar 10*b*. Rain cap 76*b* can be custom built for the Christmas tree 81*b* with which it is used, will generally be formed of two or three pieces to facilitate its installation, and could be formed with a hinge and/or a hatch to provide access to the well cellar 10*b*, as it becomes necessary.

Figure 6A:
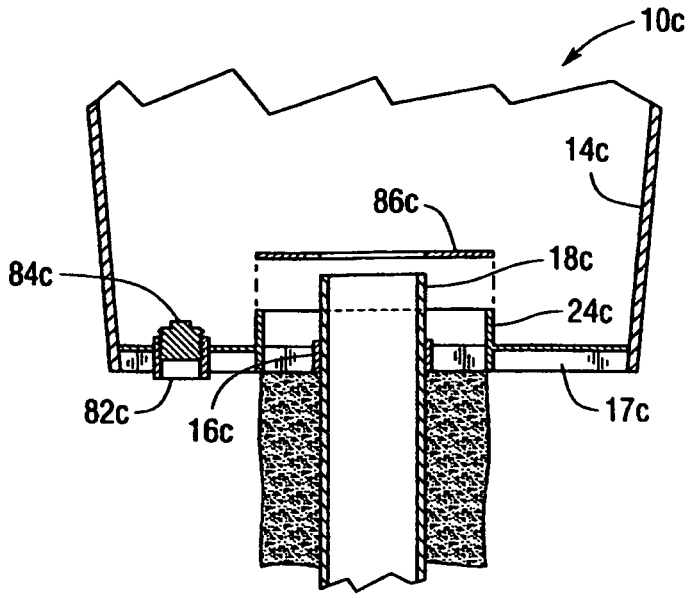
FIG. 6A is a cross-sectional side view of a third embodiment of well cellar as seen along 6A-6A in FIG. 6B.

A sealed well cellar of the present invention having additional beneficial features is depicted in FIG. 6A generally at 10*c*. In certain gas/oil well installations, the conductor pipe 18 is installed using a pile driving hammer. With those wells, any sealed well cellar of the first two embodiments could be installed by excavating a suitable opening around conductor pipe 18, sliding the cellar 10 there over, and welding the base plate thereto (or providing some alternative method of sealing). If backfilling is needed to fully stabilize the cellar 10 in its opening, this can be done as well. In other well installations, an oversized hole is drilled into which the conductor pipe 18 is inserted. It is for this well installation that this fifth embodiment is best suited.

In some embodiments, riser 24 is sealingly attached by welding, gluing or other mechanical attachment to affix it to conductor pipe 18. Riser 24 can attach to the conductor pipe 18 in other manners. For example, riser 24 can include riser walls 42 extending around the aperture substantially perpendicular to base 12 and a riser collar 44. Riser collar 44 includes a gasket ring 46, a slip segment ring 48, and a cover ring 50 which are annular in shape and sized to receive conductor pipe 18. Gasket ring 46, slip segment ring 48, and cover ring 50 are bolted, clamped or otherwise, held together.

Gasket ring 46 includes a shoulder which supports a ring gasket 52 in a recess that is partially defined by a surface 54 of slip segment ring adjacent the gasket ring. Wedge shaped slip segments 56 are disposed against the inner surface of slip segment ring 48 such that as the bolts holding gasket ring 46, slip segment ring 48 and cover ring 50 are tightened, slip segments 56 move radially inward to grip conductor pipe 18. Ring gasket 52 seals or substantially seals between riser 24 and conductor pipe 18 and prevents the flow of fluids out of cavity 15 into the surrounding earth even if the fluids rise above the top of the riser 24.

In another example, in some embodiments, a bradenhead, "A" section, wellhead, or starting head can be welded or otherwise affixed to base 12 or riser 24. In such embodiments, the slips and sealing functions are provided by the bradenhead, "A" section, wellhead or starting head. In another example, base 12 may omit the riser 24 and can incorporate gasket ring 46, slip segment ring 48, cover ring 50, slip segments 56 and ring gasket 52 or similar sealing and gripping mechanism. In alternate embodiments, riser 24 may exclude ring gasket 52, segment ring 48 and cover ring 50 and be welded or otherwise sealingly affixed to conductor pipe 18 after the conductor pipe is inserted through the riser and opening 16 in base 12. In alternate embodiments, base 12 may omit riser 24 be welded or otherwise sealingly affixed to conductor pipe 18. In such embodiments, the weld or other sealing material prevents the flow of fluids out of cavity 15 between the conductor pipe and well cellar system 10. In yet other embodiments, riser 24 can be sealingly affixed to conductor pipe 18 with a clamp mechanism (not shown).

As noted, riser 24 can be welded or otherwise sealingly affixed to base 12. Riser 24 can receive conductor pipe 18 to laterally and vertically support conductor pipe 18 and equipment attached thereto. Base 12 can be reinforced with I, L, C, boxed or other shaped channel or tubing to increase stiffness in and out of the plane of base 12. Gussets (not specifically shown) may be provided between riser 24 and base 12 to further increase stiffness. In many instances, it is desirable to leave an annular space between riser 24 or base 12 and conductor pipe 18 to allow for passage and/or circulation of fluids such as water, drilling mud (sometimes including cuttings), cement or other fluids during installation of the conductor pipe before the seal is made. The annular space may be subsequently sealed, for example, as provided herein.

Figure 3:
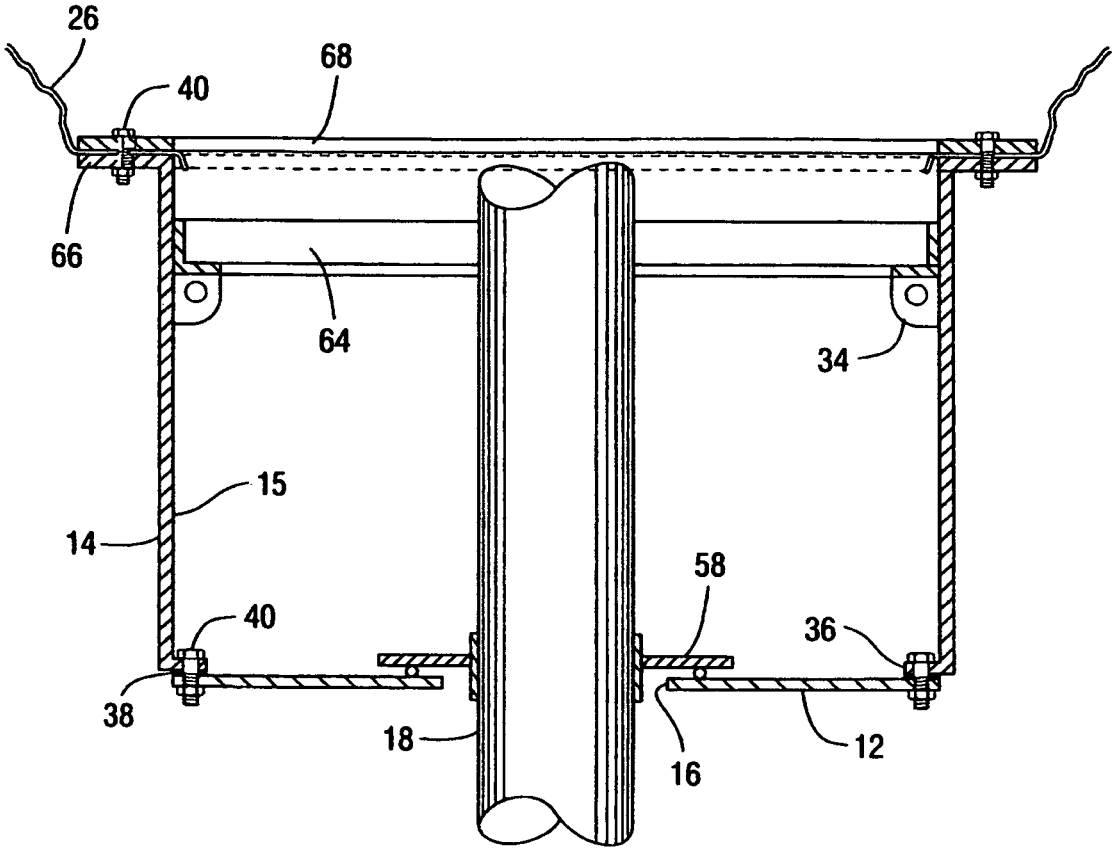
FIG. 3 is a schematic side view of a second embodiment of well cellar system.

Referring to FIG. 3, riser 24 may be omitted and a flanged fitting 58 may be provided and sealed to conductor pipe 18. Flanged fitting 58 compresses an aperture seal member 60 against base 12 to seal or substantially seal the flow of fluids out of cavity 15 between the conductor pipe and well cellar system 10. Flanged fitting 58 may be welded to conductor pipe 18 also providing a seal. Similarly, in some alternate embodiments, both flanged fitting 58 and riser 24 are omitted and conductor 18 is welded directly to base 12.

Attaching base 12 to conductor pipe 18, either directly or via riser 24, provides vertical support to conductor pipe 18 and attached equipment to reduce, and in some instances, prevent settling of conductor pipe 18 under vibration and its own weight. Further, as depicted in FIG. 3, a hoop-shaped angle iron 64 can be welded, or otherwise affixed to, interior surface of wall 14 to provide a support for a work surface which may be subsequently installed, as needed. Upper edge of wall 14 may be formed with outwardly extending flange 66 to facilitate attachment of liner 26 by bolting ring 68 thereto sandwiching liner 26. Liner 26 is only attached during drilling, and the like, and will be subsequently removed for conventional operations.

A third embodiment of the sealed well cellar of the present invention is depicted generally in FIG. 4A at 10*a*. One of the problems with existing well cellars is a natural outgrowth of the ability to perform their function well. Well cellars are designed to collect any fluids which are deposited around the conductor pipe 18. This would include runoff from rain and snow. Once this water is added to the well fluids contained in the well cellar, it becomes a hazardous waste which has to be pumped out of the cellar and disposed of in a prescribed manner. It would, therefore, be advantageous to minimize the amount of runoff which finds its way into the well cellar. An annular extension ring 70*a* is provided which can be attached to flange 66*a* of wall 14*a*. As shown in FIGS. 4A and 4B, vertical wall 72*a* has flanges 73*a*, 74*a* extending outwardly therefrom, flange 73*a* being attached by means of bolts 75*a* to flange 66*a*. A gasket can be included to ensure sealing to prevent leakage between flange 66*a* and 73*a*. Extension ring 70*a* will typically be formed in two halves 70*a*, and 70$a_2$ to facilitate installation. Halves 70*a*, and 70$a_2$ will be seam welded to ensure that there is no leakage. The configuration of extension ring 70*a* depicted here is by way of example only and the flanges need not be included. Extension ring 70*a* prevents runoff from around well cellar 10*a* from entering into the container formed thereby and becoming hazardous waste.

FIG. 5 depicts a well cellar 10*b* with rain cap accessory 76*b*. In order to further reduce entry of rain, snow, etc., into the well cellar 10*b*, a rain cap 76*b* is provided. Rain cap 76*b* has a downwardly extending flange 78*b* which overlaps extension ring 70*b*. The primary surface 79*b* slopes downwardly away from conductor pipe 18*b* to permit rain water to runoff and minimize the liquid which finds its way into the well cellar 10*b*. Rain cap 76*b* can be custom built for the Christmas tree 81*b* with which it is used, will generally be formed of two or three pieces to facilitate its installation, and could be formed with a hinge and/or a hatch to provide access to the well cellar 10*b*, as it becomes necessary.

A third embodiment of the sealed well cellar of the present invention is depicted in FIG. 6A generally at 10*c*. In certain gas/oil well installations, the conductor pipe 18 is installed using a pile driving hammer. With those wells, any sealed well cellar of the first four embodiments could be installed by excavating a suitable opening around conductor pipe 18, sliding the cellar 10 there over, and welding the base plate thereto (or providing some alternative method of sealing). If backfilling is needed to fully stabilize the cellar 10 in its opening, this can be done as well. In other well installations, an oversized hole is drilled into which the conductor pipe 18 is inserted. It is for this well installation that this fifth embodiment is best suited.

Figure 6B:
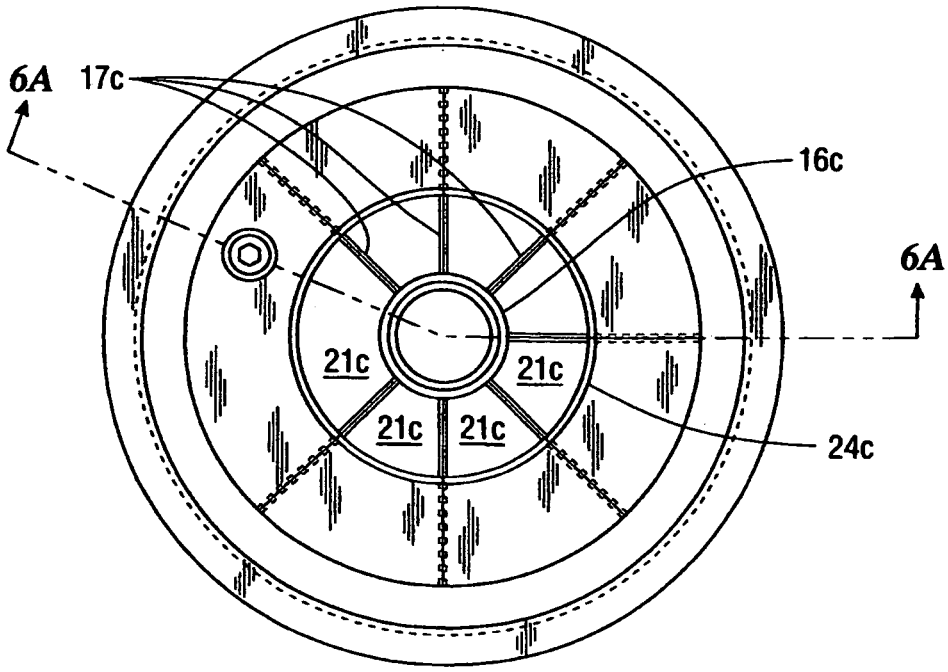
FIG. 6B is a top view of the base plate utilized in the FIG. 6A embodiment.

Well cellar 10*c* has a specially configured, substantially flat base plate 12*c* which includes a centering ring 16*c* which receives conductor pipe 18*c*. A plurality of ribs 17*c* fan out from centering ring 16*c* and are welded at their outward extent to wall 14*c*. A plurality of cement ports 21*c* (FIG. 6B) are positioned around the periphery of centering ring 16*c* and extend between centering ring 16*c* and an inner edge 11*c* of flooring plate sections 12'*c*. Flooring plate sections 12'*c* which are preferably fabricated of steel plate, are welded atop the skeleton structure formed by ribs 17*c* and wall 14*c*. A portion of flooring plate 12'*c* has a grouting port 82*c* which receives port plug 84*c* as a closure. Riser 24*c* extends through and is welded to the skeletal structure formed by ribs 17*c* at the outer periphery of cement ports 21*c*. This can be done by making ribs 17*c* of two pieces, one two fit inside riser 24*c* and one outside, or by grooving the bottom edge of riser 24*c* to enable it to sit down on ribs 17*c*.

The method of installing this embodiment of sealed well cellar includes the steps of digging a hole for, and installing well cellar 10*c* (before or after the installation of the pipe 18*c*, depending on the stability of the soil); following installation of the conductor pipe 18*c*, cementing pipe 18*c* in the hole to stabilize its position by pouring cement through cement ports 21*c* in said substantially flat base plate 12*c*; sealingly attaching said well cellar 10*c* to the conductor pipe including closing off cement ports 21*c*. An annular plate 86*c* (which is preferably made of multiple parts to facilitate its installation) is provided for that purpose. Plate 86*c* will be welded to conductor pipe 18*c* and to an upper edge of riser 24*c* to close off cement ports 21*c*. Should the soil beneath well cellar 10*c* subside or shift resulting in a partial destabilization of cellar 10*c*, grout plug 84*c* can be withdrawn from grout port 82*c* to permit materials such as a slimy of grout or sand to be injected through the port to stabilize the well cellar 10*c* and prevent its failing as occurs with conventional cellars when subsidence occurs.

Figure 7A:
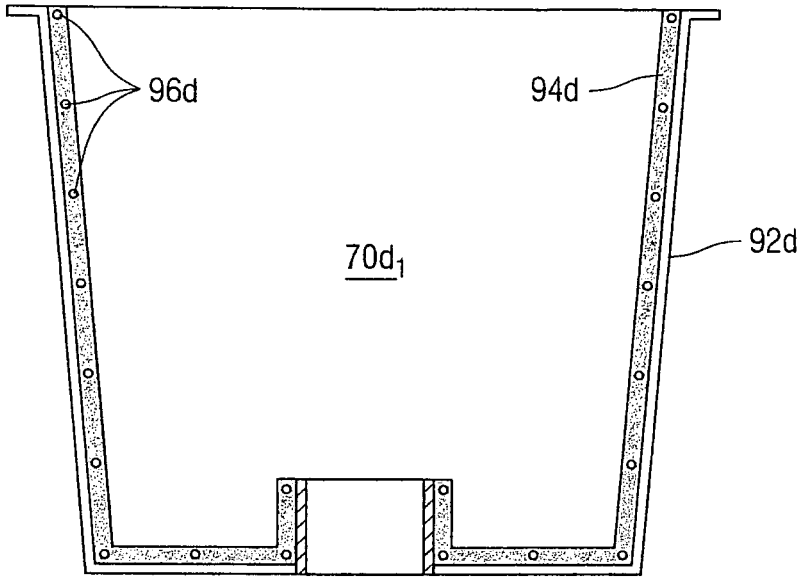
FIG. 7A is a schematic side view of one half of a fourth embodiment.
Figure 7B:
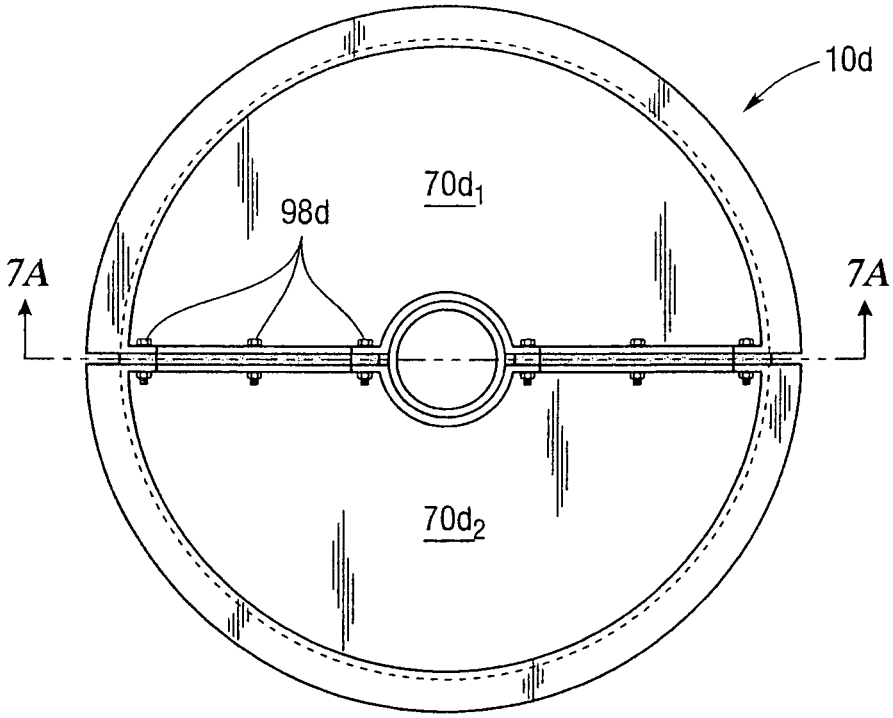
FIG. 7B is a top view of the fourth embodiment depicted in FIG. 7A.

A fourth embodiment is depicted in FIG. 7B generally at 10*d*. Well cellar 10*d* is sectional including at least two parts for ease of installation. The inwardly directed edges of halves $\mathbf{10}d_1$ and $\mathbf{10}d_2$ have flanges 92*d* formed thereon and at least one of those flanges has a gasket 94*d* (FIG. 7A) attached thereto by screws 96*d*. By drawing down bolts 98*d* flanges 92*d* compress gasket 94*d* creating a seal. This sectional embodiment 10*d* is particularly well suited as a replacement well cellar or as a liner for an existing well cellar to convert it to a sealed well cellar.

Figure 8A:
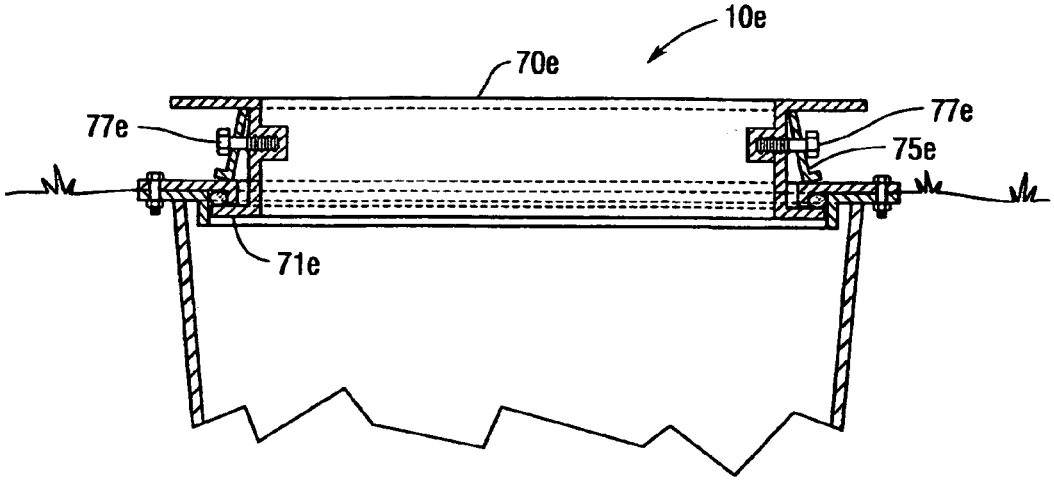
FIG. 8A a partial sectional side view of well cellar depicting a telescoping extension ring.
Figure 8B:
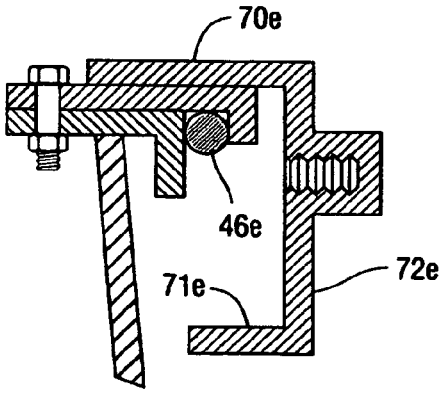
FIG. 8B is a partial sectional side view showing the extension ring in the collapsed position.
Figure 8C:
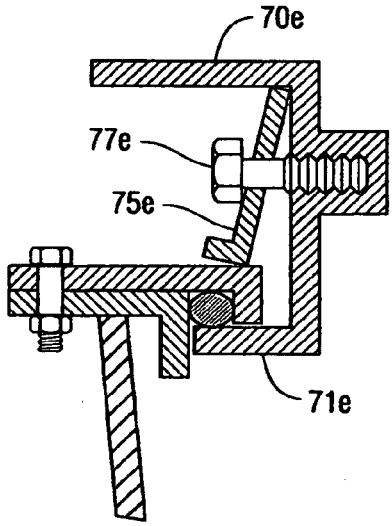
FIG. 8C is a partial sectional side view showing the extension ring in the extended position.

A sealed well cellar of the present invention featuring an extensible extension ring is depicted in FIG. 5A generally at 10*c*. In this embodiment, annular extension ring 70*e* can be collapsed (FIG. 8B) to a position enabling well cellar 10*e* to collect fluids (i.e., to function in the drilling and servicing modes). When drilling/well servicing has been completed, a plurality of camming clamps 75*e* are attached to vertical wall 72*e* by bolts 77*e* to hold extension ring 70*e* in its upward or extended position (FIGS. 8*a* and 8C). Outwardly directed lower flange 71*e* compresses gasket 46*e* to prevent leakage through the structure of extension ring 70*e*.

Figure 9A:
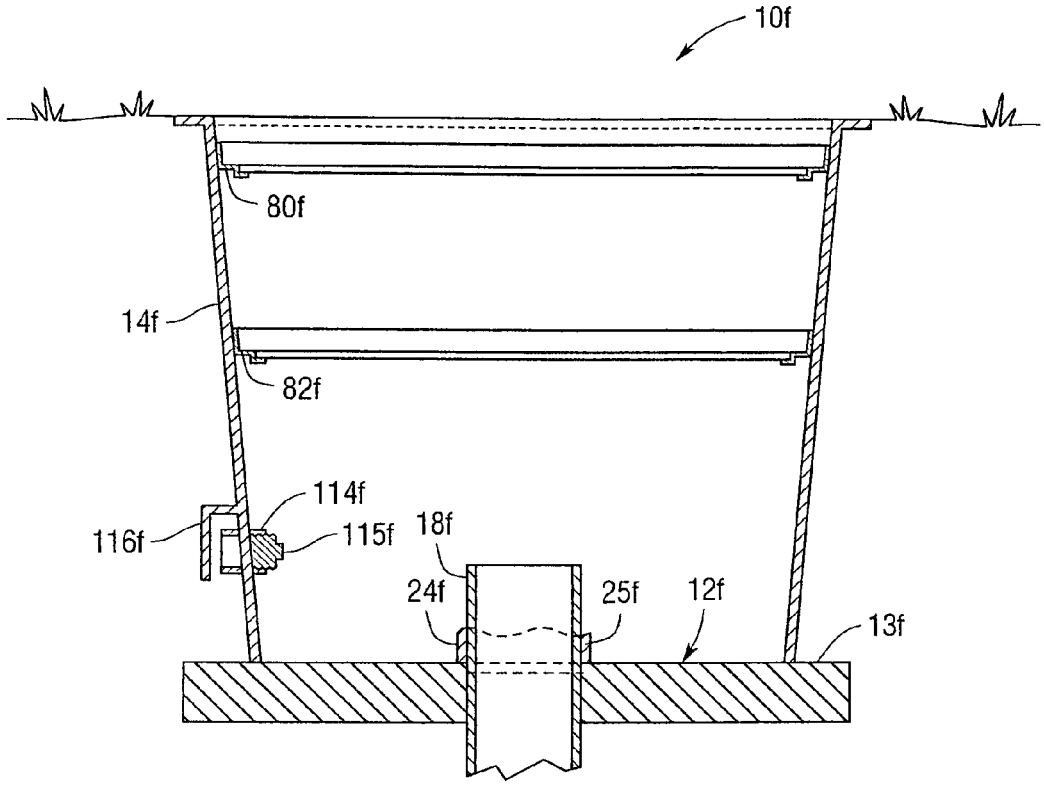
FIG. 9A is a cross-sectional side view of a fifth embodiment.

An eighth embodiment of the sealed well cellar of the present invention is depicted in FIG. 9A generally at 10*f*. In this embodiment, base plate 12*f* is provided with a radially protruding flange 13*f* which serves to anchor the well cellar 10*f* against upward floatation forces exerted upon it by ground water. It will be understood that the backfill around the well cellar 10*f* will overlie protruding flange 13*f* and provide a retention force which will counter the upwardly directed floatation forces.

Alternatively, or in addition, sidewall 14*f* may be equipped with an anti-buoyancy port 114*f* with a removable plug 115*f* in or near the base plate 12*f*. Port 114*f*, by way of example and not limitation, may take the form of a 4" internally threaded pipe coupling. Plug 115*f* may be removed during installation where the water table is high to allow an equalization of the internal and external water pressure to avoid floating of the well cellar 10*f*. The port 114*f* is equipped with a guard shield 116*f* attached to the exterior of wall 14*f* as by welding to reduce the ingress of fluid-borne solids during this stabilization process. Once the well cellar 10*f* is installed and welded to the conductor pipe, plug 115*f* can be inserted to seal off the flow of fluids through port 114*f* and the water removed from inside cellar 10*f*.

Figure 9B:
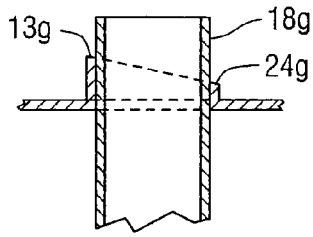
FIG. 9B is a side view of a variation of the fifth embodiment comprising a sixth embodiment.

As seen in FIG. 9A, the top of the riser 24*f* has a scalloped edge 25*f*. Scalloped edge 25*f* or the exterior of conductor pipe 18*f* may be crimped to bring the two surfaces into closer proximity to facilitate welding or other forms of mechanical attachment. Welding is the preferred method of securing the two members and, by not having the weld lying in a single horizontal cross section, the chances of the weld holding up long term are significantly enhanced. Alternatively, another way of accomplishing the desired result is to bevel the top (FIG. 9B) of the riser 24*g* as at 25*g*.

Reverting to FIG. 9A, a first annular support 80*f* is provided for a work platform to enable maintenance, cleaning, and other types of work to be conducted on the well drilling/production equipment suspended from riser 18*f*. It is an additional feature of the well cellar 10*f* of this invention to provide a second annular support 82*f* welded to the inner surface of wall 14*f* at a level that is just above that which is established by OSHA as creating a confined space entry. By positioning the annular support 82*f* at this level, the restrictions associated with confined space entries are avoided.

Figure 10:
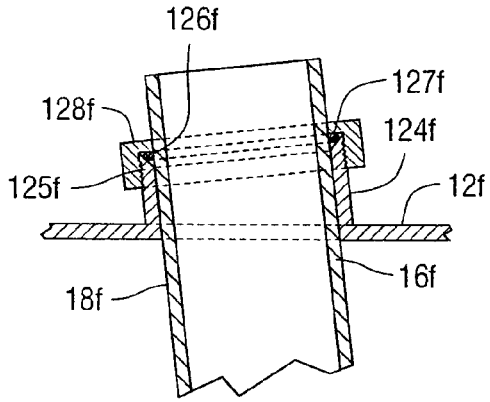
FIG. 10 is a schematic side view depicting another feature of the fifth embodiment; and, FIG. 11 is a schematic side view depicting a seventh embodiment.

Another feature of this fifth embodiment 10*f* is shown in FIG. 10 generally at 16*f*. In unsealed well cellars, it is conventional to have mouse holes or rat holes to afford a place for auxiliary well drilling and completion tools to go. With the advent of the sealed well cellar 10 of the present invention, it is necessary to provide a sealed opening for such equipment. If one or more additional holes 16*f* is formed in base plate 12*f*, each will need to be sealed. It is proposed that such holes 16*f* each be provided with a riser section 124*f* with external threads 125*f* at the top. Riser section 124*f* is canted relative to base plate 121. An elastomeric gasket 127*f* can be compressed between upper beveled surface 126*f* of riser section 1241 and the internal bottom surface of hammer nut 128*f*. Compressed gasket 127*f* will fill all the space between the riser section 124*f* and conductor pipe 18*f*. Although the auxiliary hole(s) has/have been depicted as through the base plate 12*f*, it will be appreciated that the hole(s) could be through side wall 14*f* without departing from the scope of the invention.

Figure 11:
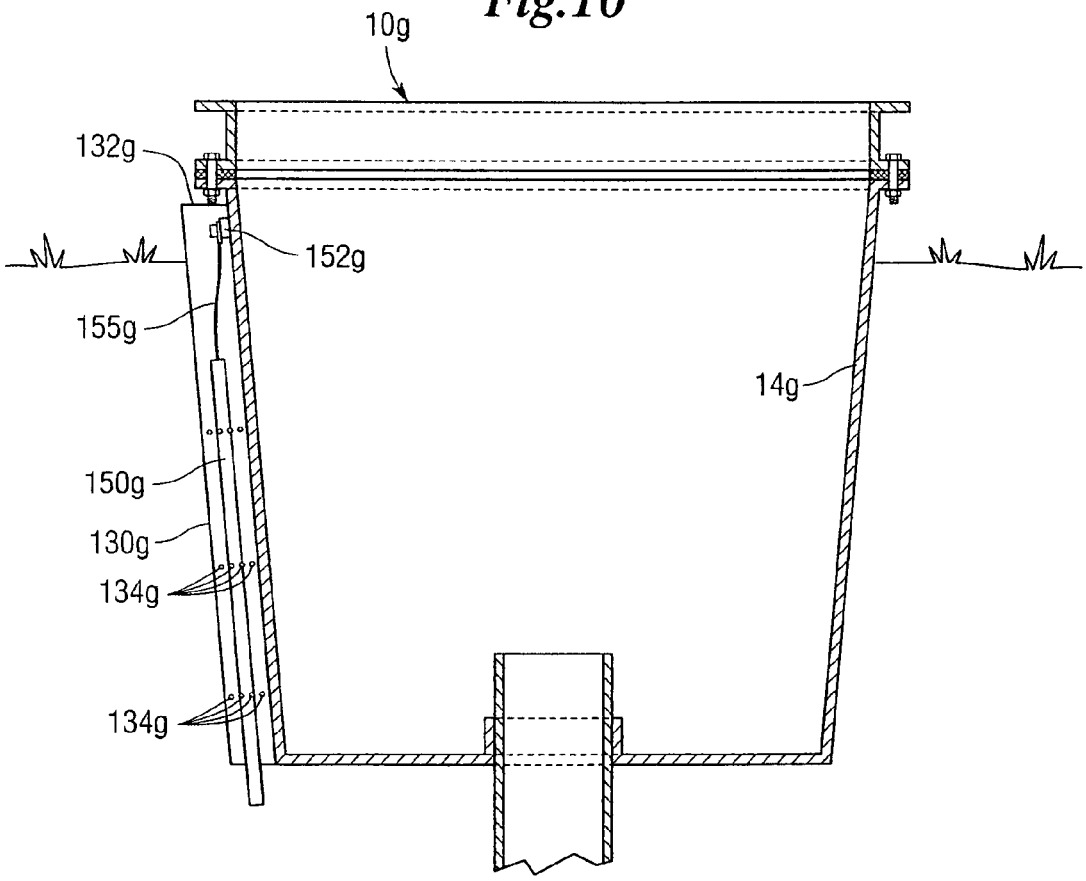

A ninth embodiment is depicted generally at 10*g* in FIG. 11. A housing 130*g* is provided for the sacrificial anode 150*g* mounted to the outside of sidewall 14*g*. Housing 130*g* is provided with a removable lid 132*g* to allow anode 150*g* to be inspected and replaced as necessary. Housing 130*g* is provided with a series of holes 134*g* to enhance access between the anode 150*g* and the electrolyte provided to facilitate the reaction. An anode connection 152*g* attaches the anode 150*g* to the wall 12*g* by a wire 155*g*.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A sealed well cellar comprising a) an integral structural base plate, said base plate having an opening therein for receiving a conductor and being load-bearing;

b) a vertically extending side wall formed integrally with said base plate to ensure sealing between said vertically extending side wall and said base plate;

c) a riser positioned in said opening in said base plate, said riser comprising a cylindrical pipe section extending coaxially with the conductor;

d) first sealing means comprising a weld between said base plate and said riser preventing fluid flow between said base plate and said riser;

e) second sealing means comprising a weld between said riser and the conductor preventing fluid flow between said riser and the conductor;

whereby said first and second seal means have sufficient structural integrity to transfer a weight of the conductor and associated drilling equipment to said integral structural base plate.

2. A sealed well cellar comprising a) an integral structural base plate, said base plate having an opening therein for receiving a conductor and being load-bearing;

b) a vertically extending side wall formed integrally with said base plate to ensure sealing between said vertically extending side wall and said base plate;

c) a riser positioned in said opening in said base plate;

d) first sealing means between said base plate and said riser preventing fluid flow between said base plate and said riser;

e) second sealing means between said riser and the conductor preventing fluid flow between said riser and the conductor said second seal means comprises a weld between said riser and the conductor wherein said weld is configured such that no single horizontal cross section taken through said conductor at said weld passes through 100% of said weld;

whereby said first and second seal means have sufficient structural integrity to transfer a weight of the conductor and associated drilling equipment to said integral structural base plate.

3. The well cellar of claim 2 wherein an upper edge of said riser is beveled.

4. The well cellar of claim 2 wherein an upper edge of said riser is scalloped.

5. A sealed well cellar comprising a) an integral structural base plate, said base plate having an opening therein for receiving a conductor and being load-bearing;

b) a vertically extending side wall formed integrally with said base plate to ensure sealing between said vertically extending side wall and said base plate;

c) a riser positioned in said opening in said base plate;

d) first sealing means between said base plate and said riser preventing fluid flow between said base plate and said riser;

e) second sealing means between said riser and the conductor preventing fluid flow between said riser and the conductor;

f) a laterally extending flange portion of said integral structural base plate serving as an anchor to said well cellar to counteract buoyancy effects due to ground water and prevent said well cellar from experiencing movement from upward floatation forces.

* * * * *